United States Patent [19]

Nishimura et al.

[11] 3,939,641

[45] Feb. 24, 1976

[54] ELECTRONIC CIRCUIT FOR INDIVIDUALLY CORRECTING EACH DIGIT OF TIME DISPLAYED

[75] Inventors: Izuhiko Nishimura; Mitsuharu Kodaira, both of Suwa, Japan

[73] Assignee: Kabushiki Kaisha Suwa Seikosha, Tokyo, Japan

[22] Filed: July 31, 1974

[21] Appl. No.: 493,428

[30] Foreign Application Priority Data

July 31, 1973 Japan ..... 48-86185

[52] U.S. Cl. ..... 58/23 R; 58/85.5

[51] Int. Cl.[2] ..... G04C 3/00; G04B 27/08

[58] Field of Search ..... 58/50 R, 85.5, 23 R

[56] References Cited

UNITED STATES PATENTS

| | | | |
|---|---|---|---|
| 3,668,859 | 6/1972 | Polin et al. | 58/85.5 X |
| 3,733,810 | 5/1973 | Girard | 58/85.5 X |
| 3,756,011 | 9/1973 | Nishimura et al. | 58/85.5 X |

*Primary Examiner*—L. T. Hix
*Assistant Examiner*—U. Weldon
*Attorney, Agent, or Firm*—Blum, Moscovitz, Friedman & Kaplan

[57] ABSTRACT

A correction circuit for an electronic timepiece is provided wherein a divider stage can be corrected without effecting correction of any other digit of the electronic timepiece to be corrected. The electronic timepiece includes a quartz crystal oscillator circuit for producing a high frequency time standard signal, a divider circuit including a plurality of divider stages adapted to receive said high frequency timekeeping signals, certain of the divider stages being adapted to produce low frequency timekeeping signals in response to said high frequency timekeeping signals, and display elements associated with said certain divider stages for displaying the time counted thereby in response to said timekeeping signals applied thereto. The electronic timepiece includes a correction circuit including a portion intermediate a divider stage to be corrected and the next divider stage for inhibiting the carry signal from the divider stage to be corrected, whereby the next divider stage is not advanced by the carry signal of the divider stage to be corrected. In one embodiment, an inhibit circuit is corrected to receive the corrected carry signal from divider stage to be corrected and the carry signal from the next-previous divider stage and adapted to inhibit the transmission of that portion of the corrected carry signal representative of a carry due to correction to the next divider stage.

8 Claims, 5 Drawing Figures

ELECTRONIC CIRCUIT FOR INDIVIDUALLY CORRECTING EACH DIGIT OF TIME DISPLAYED

BACKGROUND OF THE INVENTION

This invention is directed to an electronic timepiece correction circuit and in particular to a correction circuit adapted to advance the count of a divider stage to be corrected without effecting an advance of the subsequent divider stages counting a lower frequency signal than the divider stage to be corrected. Although correction of each display digit in an electronic digital wristwatch is achieved by manually advancing the count of the divider stage providing timekeeping signals to the display digit to be corrected, such advancement causes the carry signal produced by the divider stage to be corrected to be advanced, thereby advancing the count of the next divider stage. For example, if the minute divider stage is advanced by one, the next divider stage, namely, the hours and date divider stages are advanced by a time period equal to the amount which the minute divider stage was advanced to. Thus, if the display reads 10:59:47 and it is desired to change the minute digit from 9 to 6, if the minute digit is advanced by seven to read 6, the 10 minute display, hour display and calendar display will be advanced by seven minutes, the time by which the minute display to be corrected is advanced. Nevertheless, since the actual time was 10:56:47, and the only incorrect digit was the minute digit, it is necessary to correct each of the subsequent divider stages which were advanced by the correction of the minutes digit, a condition which is less than completely satisfactory.

SUMMARY OF THE INVENTION

Generally speaking, in accordance with the invention, an improved correction circuit for correcting the count of a divider stage without advancing the count of the next divider stage is provided. The electronic timepiece includes a quartz crystal oscillator circuit for producing the high frequency time standard signal, a divider circuit including a plurality of divider stages adapted to receive the high frequency time-keeping signals, certain of the divider stages being adapted to produce low frequency timekeeping signals in response to said high frequency time standard signal and display means associated with said certain divider stages for displaying the time counted thereby in response to the timekeeping signals. A correction circuit means includes means for inhibiting the carry signal from the divider stage to be corrected during correction, whereby the next divider stage is not advanced by the advancement of the count of the divider stage to be corrected.

Said means for inhibiting the carry signal may include a control circuit means intermediate the divider stage to be corrected and the next divider stage. In one embodiment, control circuit means includes an inhibit circuit connected to receive the corrected carry signal from the divider stage to be corrected and the carry signal from the next-previous divider stage and is adapted to inhibit the transmission of that portion of the corrected carry signal representative of a carry due to correction to the next divider stage. In a second embodiment, the control circuit means inhibits the application of the carry signal of the divider stage to be corrected in response to a correction actuation signal.

Accordingly, it is an object of this invention to provide an improved electronic timepiece wherein a divider stage is corrected without affecting the count of the other divider stages counting signals for display.

A further object of this invention is to provide an improved electronic timepiece wherein the carry signal to the next divider stage is not advanced in response to advancement of the count of the divider stage to be corrected.

Still another object of this invention is to provide an improved electronic timepiece having a digital display wherein the carry signals from a divider stage counting a smaller unit of time is utilized as a correction signal for the next larger digit of time and is further utilized to inhibit the correction signal from affecting the next further digit of time.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings.

DETAILED DESCRIPTION OF THE PREFERRED EMBODIMENTS

Figure 1:
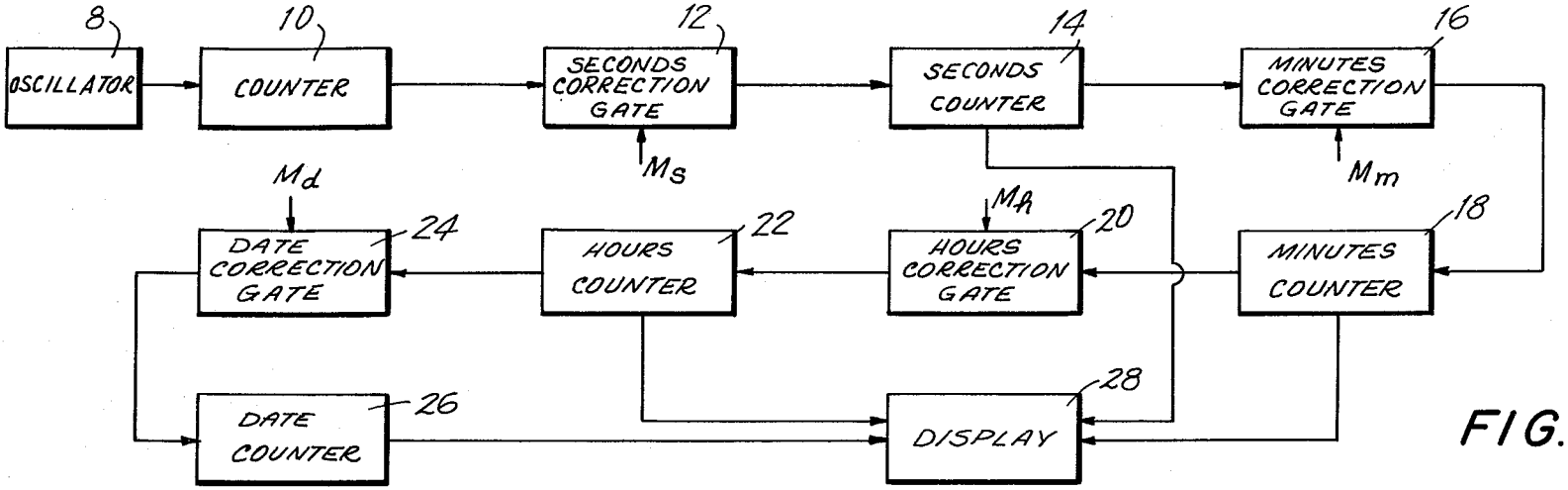
FIG. 1 is an electronic timepiece including a correction circuit constructed in accordance with the prior art.

Reference is now made to FIG. 1, wherein an electronic timepiece constructed in accordance with the prior art and including the digital display is depicted. A counter divider circuit 10 is adapted to receive a high frequency time standard signal produced by quartz crystal oscillator circuit 8 and in response thereto produced a one second signal. The one second signal is applied to a seconds correction gate 12 which, in the absence of a selectively applied correction signal $M_s$ supplies the one second signal to seconds counter 14. The seconds counter 14 provides an output to display circuit 28 and further counts down the seconds signals and supplies a minute timekeeping signal to minutes correction gate 16 and minutes counter 18. The same display and count down of the timekeeping signal is effected by hours correction gate 20 and hours counter 22 and date correction gate 24 and date counter 26, the output of each of the seconds, minutes, hours, and date counters being displayed by digital display 29. If, for example, the minutes display is to be corrected, a correction signal $M_m$ is applied to minute correction gate 16 and in response to the carry signal from the seconds counter 14 and the correction signal $M_m$, minute correction gate 16 provides a corrected carry signal to minutes counter 18 to thereby advance the count thereof. Accordingly, the minute digit is thereby corrected. However, when the minute counter 18 is corrected, the hour counter 22 and the date counter 26 are advanced by an amount equal to the amount the minute counter is corrected. For example, if the minutes counter is advanced by 4 units to correct the count thereof, which is four minutes slow, the count of the hours counter 22 and the date counter 26 are advanced by four minutes. Thus, if the minutes counter displays a digit which is greater than the digit to be corrected to, such as correcting 8 to 2, it is then necessary to advance the counter past zero to the number 2. When such advancing occurs, the hours and date counters must also be reset because the advancing of the minutes counter to zero causes an extra counter signal (carry signal) to be applied to the hours counter. Accordingly, advancement of the counter counting the digit of time to be corrected may cause counters corresponding to the digits counting larger periods of time to advance, rendering necessary the correction of the subsequent counters.

Figure 2:
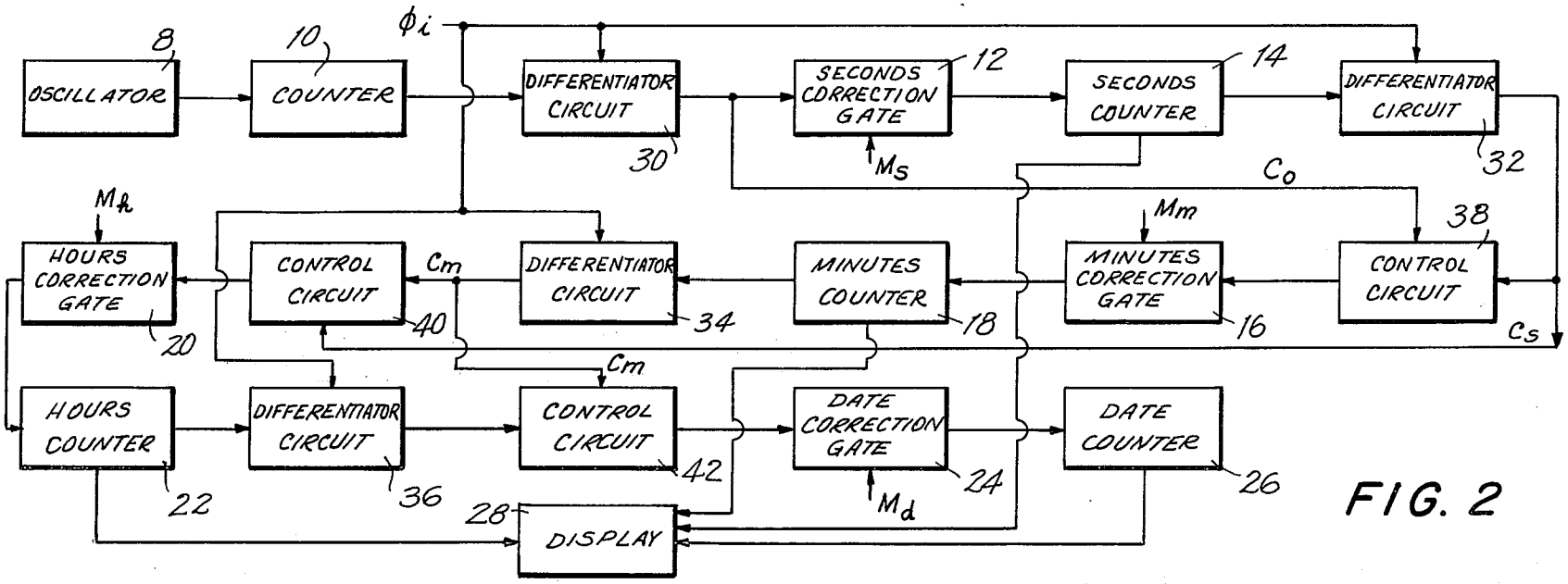
FIG. 2 is a circuit diagram of an electronic timepiece including a correction circuit constructed in accordance with the instant invention.

Reference is now made to FIG. 2, wherein an electronic digital display wristwatch circuit constructed in accordance with the instant invention is depicted and wherein the defect hereinabove noted with respect to the prior art is eliminated. Like numerals are utilized to denote like elements. Accordingly, the correction circuit in addition to the correction gates 12, 16, 20 and 24 intermediate each of the seconds, minutes, hours and date counters further includes differentiator circuits 30, 32, 34 and 36 respectively disposed at the output of counter 10 adapted to produce a one second carry signal, the seconds counter 14 adapted to produce a minutes carry signal, minutes counter 18 adapted to produce an hour carry signal and hours counter 22 adapted to produce a date carry signal. Each differentiation circuit converts the carry signal applied thereto to a pulse signal of a period determined by a high frequency signal $\phi_i$, preferaby taken from a higher frequency stage of counter 10. The high frequency signal $\phi_i$ also ensures a proper phase relation between the various differentiated carry signals. The correction circuit further includes control circuit 38 disposed intermediate the differentiator circuit 32 and minute correction gate 16, control circuit 40 intermediate differentiator circuit 34 and the hour correction gate 20, and control circuit 42 intermediate differentiator circuit 36 and date correction gate 24. Each of the control circuits 38, 40, 42 are adapted to receive, as a first output the differentiated carry signal from the differentiator circuit just prior thereto and a further differentiated carry signal from the differentiator circuit prior to the next-previous divider stage, and in response thereto apply a carry signal inhibited during correction to the next correction gate. Thus, for example, the minute control circuit 38 receives, as a first input, the output from the differentiator circuit 30 and, as a second input, the output from differentiator circuit 32, and in response thereto applies a signal to the minute correction gate 16.

In operation, if it is desired to correct the minutes display, the minutes counter 18 is advanced by the application of a correction signal $M_m$ to the minutes correction gate, which, in turn, advances minutes counter 18 to the correct number to be displayed thereby. The application of the correction signal $M_m$ advances the count of the carry signal from minutes counter 18 applied to differentiator circuit 34. A differentiated output carry signal $C_m$ is produced by differentiator circuit 34, which signal is applied as a first input to control circuit 40. A further input to control circuit 40 is a differentiated signal $C_s$ which is the seconds counter 14 carry signal differentiated by differentiator circuit 32. Accordingly, control circuit 40 compares the phase relation between the differentiated signals $C_m$ and differentiated signals $C_s$ and only the pulses of signal $C_m$ in phase with $C_s$ are transmitted to the next digit correction gate 20. Pulses due to the advance of minutes counter 18 by correction signal $M_m$ would lack the required phase relation, so that carry signals caused thereby are inhibited.

Figure 3A:
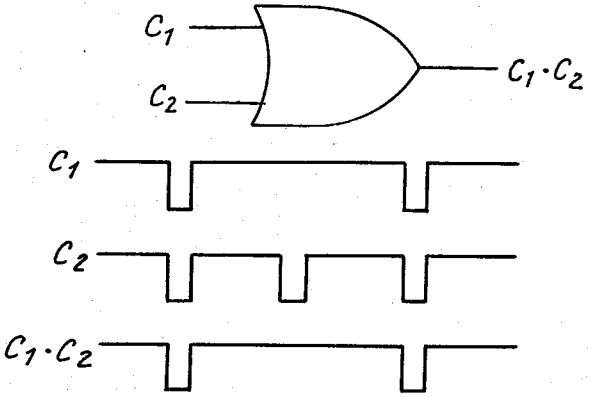
FIGS. 3*a*, 3*b* are wave diagrams of respective control circuits for use in the electronic timepiece circuit illustrated in FIG. 2.
Figure 3B:
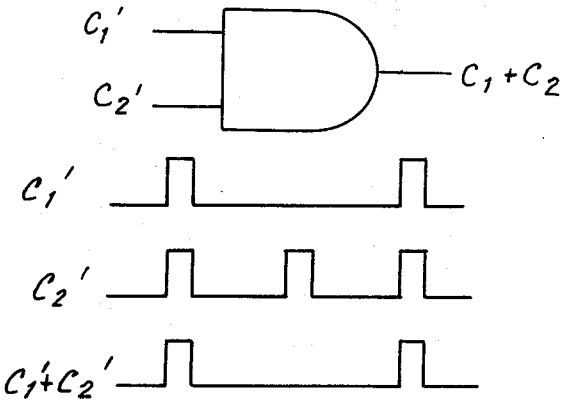

It is noted that the defect hereinabove noted in the prior art is eliminated by permitting the carry signal from the divider stage in advance of the divider stage to be corrected to be utilized to inhibit the carry signal of the divider stage to be corrected. As is clearly illustrated in FIGS. 3*a* and 3*b*, respectively, the control circuit can be an OR gate, or an AND gate depending on the nature of the differentiated signals, each such gate producing the inhibited signals depicted therein.

Figure 4:
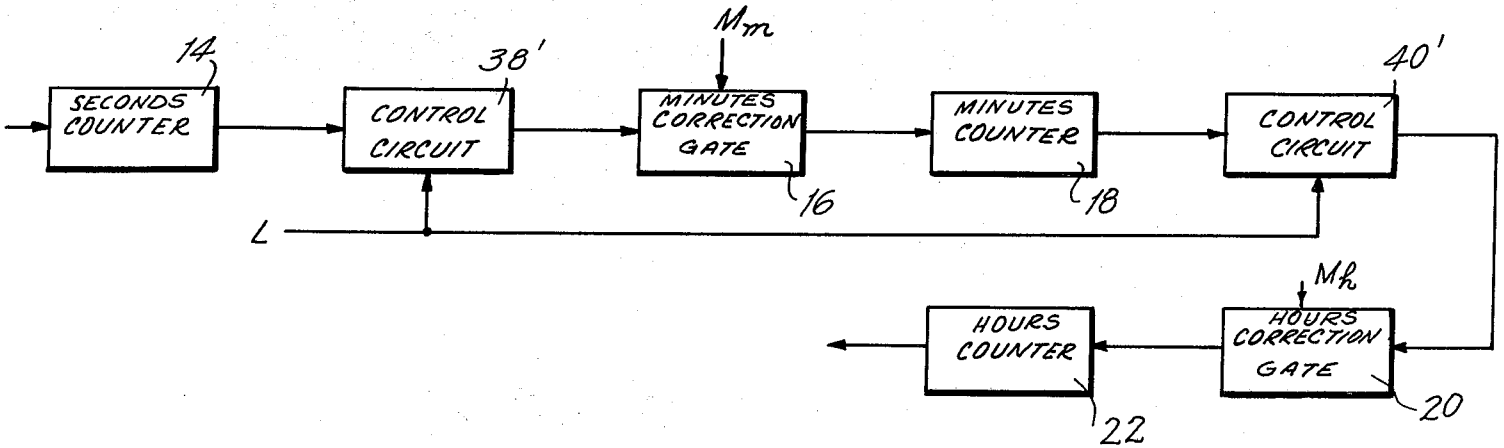
FIG. 4 is a circuit diagram of an electronic timepiece correction circuit constructed in accordance with another embodiment of the instant invention.

Still another carry signal inhibit circuit in accordance with the invention is illustrated in FIG. 4. Like reference numerals are used to refer to like elements. The circuit is similar to FIG. 2, without the differentiator circuits. All the carry signals from the respective timekeeping counters are inhibited by the respective control circuit at the time of correction. Thus, the respective control circuits 38', 40' would include a gate circuit responsive to a correction actuation signal L for inhibiting the transmission of carry signals between selected divider stages during correction. The correction actuation signal L could be either an 0 or 1 depending on the setting of a separate control such as a lock switch which selectively permits or prevents correction.

It should be noted here, a timekeeping divider stage may refer to a stage producing timekeeping signals controlling a single digit of the display, such as the one-second digit, or it may refer to a stage producing timekeeping signals controlling more than one digit such as both the one-second and ten-second digits.

It will thus be seen that the objects set forth above, among those made apparent from the preceding description are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece comprising a quartz crystal oscillator circuit for producing a high frequency time standard signal, divider means coupled to said oscillator means for producing a low frequency time standard carry signal in response to said high frequency time standard signal, at least two series-connected divider stages coupled in series with said divider means, each divider stage other than the last of said series connected divider stages producing a low frequency carry signal in response to the low frequency carry signal applied thereto, at least a portion of said divider stages each producing timekeeping signals and display means associated with each said divider stage producing said timekeeping signals for displaying time in response to said respective timekeeping signals applied thereto, the improvement comprising correction gate means coupled to each said divider stage producing a timekeeping signal, each said correction gate means being adapted to apply the carry signal from the next previous divider stage to the divider stage to which said correction gate means is coupled and being adapted to correct each divider stage by advancing the count thereof, and a control circuit means connected to each divider stage to be corrected to receive the carry signal produced thereby and the carry signal applied to said divider stage to be corrected, said control circuit means inhibiting the transmission to the next divider stage following said divider stage to be corrected of that portion of the corrected carry signal representative of a carry due to correction.

2. An electronic timepiece as claimed in claim 1, wherein said divider means is adapted to produce an intermediate frequency signal, and including a differentiator circuit means coupled to the output of said divider means and of each divider stage producing a carry signal for application to a divider stage to be corrected, for maintaining the carry signal applied to each said divider stage to be corrected and said corrected carry signal in phase, each of said differentiator circuit means being adapted to receive said carry signal applied to said divider stage to be corrected and said intermediate frequency signal and in response thereto apply to said respective control circuit means pulse carry signals having like phase and period.

3. The electronic timepiece as claimed in claim 1, wherein said control circuit means includes means for maintaining each divider stage carry signal applied to said divider stage to be corrected and said corrected carry signal of the divider stage to be corrected in phase.

4. An electronic timepiece as claimed in claim 1, wherein the further divider stages include a minutes divider stage and an hours divider stage.

5. An electronic timepiece as claimed in claim 4, wherein the first divider stages is a a seconds divider stage.

6. An electronic timepiece as claimed in claim 4, where a further divider stages to be corrected includes a date divider stage.

7. An electronic timepiece as claimed in claim 2, wherein said control circuit means is an AND gate.

8. An electronic timepiece as claimed in claim 2, wherein said control circuit means is an OR gate.

* * * * *